US009995539B2

(12) United States Patent
Bungo et al.

(10) Patent No.: US 9,995,539 B2
(45) Date of Patent: Jun. 12, 2018

(54) CORRUGATED FINS FOR HEAT EXCHANGER

(71) Applicant: T.RAD Co., Ltd., Tokyo (JP)

(72) Inventors: Takuya Bungo, Tokyo (JP); Noriyuki Ishii, Tokyo (JP); Atsushi Okubo, Tokyo (JP); Taiji Sakai, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 0 days. days.

(21) Appl. No.: 15/510,808

(22) PCT Filed: Sep. 15, 2015

(86) PCT No.: PCT/JP2015/077002
§ 371 (c)(1),
(2) Date: Mar. 13, 2017

(87) PCT Pub. No.: WO2016/043340
PCT Pub. Date: Mar. 24, 2016

(65) Prior Publication Data
US 2017/0284748 A1 Oct. 5, 2017

(30) Foreign Application Priority Data
Sep. 19, 2014 (JP) ..... 2014-191512

(51) Int. Cl.
*F28F 1/20* (2006.01)
*F28F 1/12* (2006.01)
*F28F 1/40* (2006.01)

(52) U.S. Cl.
CPC ..... *F28F 1/126* (2013.01); *F28F 1/40* (2013.01)

(58) Field of Classification Search
CPC .... F28F 1/126; F28F 1/40; F28F 3/027; F28F 1/128; F28F 1/10; F28F 1/12; F28F 1/24;
(Continued)

(56) References Cited

U.S. PATENT DOCUMENTS 4,854,380 A * 8/1989 Yoshida ..... F28F 1/126 165/148
4,869,316 A * 9/1989 Yoshida ..... F28F 1/325 165/148
(Continued)

FOREIGN PATENT DOCUMENTS

JP 4-15492 A 1/1992
JP 8-510047 A 10/1996
(Continued)

*Primary Examiner* — David Hwu
(74) *Attorney, Agent, or Firm* — Norris McLaughlin & Marcus, P.A.

(57) ABSTRACT

Corrugated fins that have high heat transfer performance and do not cause clogging even in a gaseous environment in which particulate matter such as dust is present have wall surfaces on which are formed alternating parallel ridges and furrows with an angle of inclination of 10-60°. Defining Wh as the height of the ridges and furrows, Wp as the period of the ridges and furrows, Pf as the period of the corrugated fins, and Tf as the thickness of the plate forming the fins, the following conditions hold.

$Wh \leq 0.3674 \cdot Wp + 1.893 \cdot Tf - 0.1584$, $0.088 < (Wh - Tf)/Pf < 0.342$, and $a \cdot Wp2 + b \cdot Wp + c < Wh$, where $a = 0.004 \cdot Pf^2 - 0.0696 \cdot Pf + 0.3642$ $b = -0.0036 \cdot Pf^2 + 0.0625 \cdot Pf - 0.5752$, and $c = 0.0007 \cdot Pf^2 + 0.1041 \cdot Pf + 0.2333$.

3 Claims, 12 Drawing Sheets

(58) Field of Classification Search
CPC ..... F28D 1/05383; F28D 1/04; B01J 9/249; B23K 1/0012; B21D 13/00
USPC ..... 165/181
See application file for complete search history.

(56) References Cited

U.S. PATENT DOCUMENTS

| | | | | |
|---|---|---|---|---|
| 5,623,989 | A | 4/1997 | Kroeger | |
| 7,614,443 | B2 | 11/2009 | Usui et al. | |
| 2002/0124404 | A1* | 9/2002 | Morihira | B21D 13/00 29/890.03 |
| 2004/0040153 | A1* | 3/2004 | Ashida | B23K 1/0012 29/890.03 |
| 2004/0173344 | A1* | 9/2004 | Averous | B01J 19/249 165/173 |

FOREIGN PATENT DOCUMENTS

| | | | |
|---|---|---|---|
| JP | 10-160375 | A | 6/1998 |
| JP | 2004-60934 | A | 2/2004 |
| JP | 2007-78194 | A | 3/2007 |
| JP | 2013-50303 | A | 3/2013 |
| JP | 2013-139978 | A | 7/2013 |
| WO | 2014/077316 | A1 | 5/2014 |
| WO | 2014/077318 | A1 | 5/2014 |

* cited by examiner

Machining limit

Fan matching heat radiation amount ratio

Renge where Qf > 100% with Pf = 9.0 mm

Fig.15 (a-a)
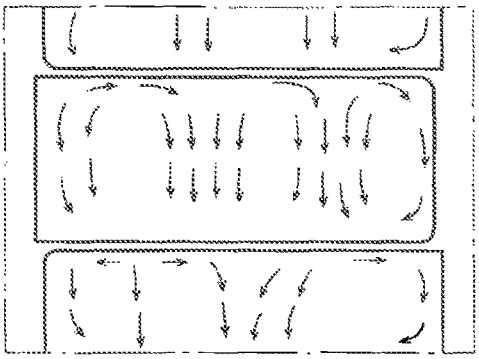
Fig.15 (b-b)
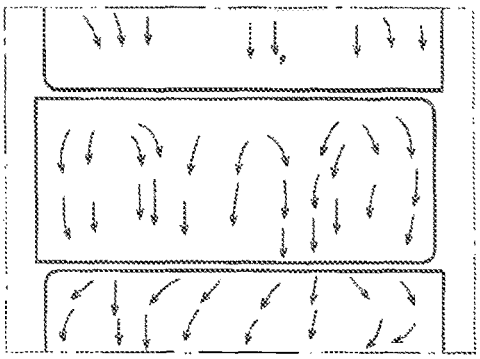
Fig.15 (c-c)
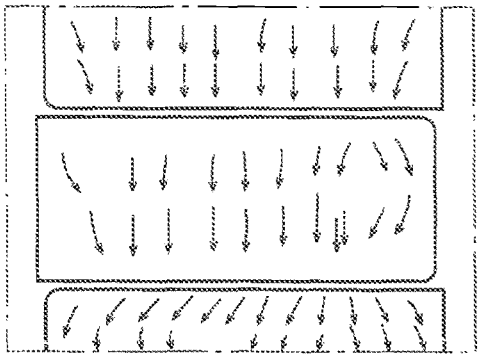
Fig.15 (d-d)
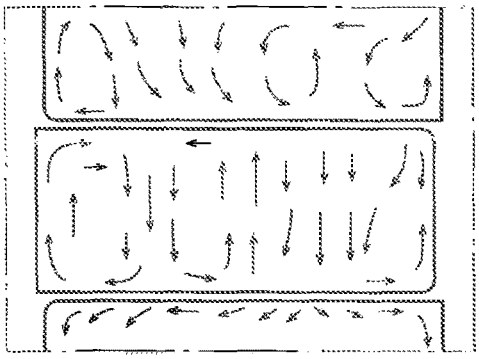

CORRUGATED FINS FOR HEAT EXCHANGER

BACKGROUND OF THE INVENTION

The present invention relates to corrugated fins for heat exchanger to be interposed between flat tubes or to be installed in the flat tube, ridges and furrows being alternately arranged on a rising wall surface and a falling wall surface thereof.

As the corrugated fins for heat exchanger which make clogging difficult to occur and which can be applied also to a gaseous body which contains many particulate matters such as dust, for example, the fin described in the following Patent Literature 1 is known and is used in a heat changer and an exhaust heat exchanger of construction machinery.

The invention described in Japanese Patent Laid-Open No. 2007-78194 is a rectangular-wave-shaped corrugated fin in which peak parts and valley parts of the wave have run meandering in a longitudinal direction as shown in FIG. 16 and FIG. 17 (hereinafter, referred to as a conventional type corrugated fin). The fin described in Japanese Patent Laid-Open No. 2007-78194 is used as an inner fin to be installed in a tube and which stirs a gaseous body which flows through within it by making it meandering from the upstream side to the downstream side so as to reduce a boundary layer generated on the wall surface as much as possible.

SUMMARY OF THE INVENTION

Although the conventional type corrugated fin described in Japanese Patent Laid-Open No. 2007-78194 has the effect of suppressing development of the boundary layer, it was not sufficient. In addition, there was a problem in productivity such as a warp in a fin height direction in association with machining of the wave shape.

Therefore, a corrugated fin which is higher in heat transfer performance and is high in productivity has been required.

Accordingly, as a result of various experiments and fluid analyses, the inventors of the present invention have found the specification of the fin which is higher in heat transfer performance and is easier to produce than the corrugated fin of the above-mentioned Japanese Patent Laid-Open No. 2007-78194.

That is, they have developed the corrugated fin which is higher in heat transfer performance and is easier to manufacture than the fin described in the above-mentioned Japanese Patent Laid-Open No. 2007-78194 by specifying a plate thickness thereof, a period of ridges and furrows, a height of the ridges and the furrows and a period of the corrugated fins to fixed ranges, when alternately and repetitively forming the ridges and the furrows on wall surfaces which serve as a rising surface and a falling surface of the corrugated fin.

The present invention according to a first aspect thereof is corrugated fins for heat exchanger to be interposed between flat tubes which are arrayed side by side separately from each other or to be installed in the flat tube, in which the material of the fin is aluminum or an aluminum alloy, the fin is 0.06 to 0.16 mm in plate thickness and has respective wall surfaces (3) of a rising part and a falling part between a peak part and a valley part which are bent into a waveform in a longitudinal direction of the fin, ridges (4) and furrows (5) which are 10 degrees to 60 degrees in angle of inclination relative to a width direction of the fin and are in the same direction are alternately arrayed side by side on the respective wall surfaces (3), and when a height of the ridges and furrows (an external dimension from the valley of a furrow part to the peak of a ridge part, including a plate thickness) is set to Wh [mm], a period of the ridges and furrows (a period from a certain ridge to the next ridge) is set to Wp [mm], a period of the corrugated fins is set to Pf [mm] and the plate thickness of the fin is set to Tf [mm], the corrugated fins satisfy the following conditions and a gaseous body flows in the width direction of the fins, $$Wh \leq 0.3674 \cdot Wp + 1.893 \cdot Tf - 0.1584 \quad \text{[Formula 1]}$$

$$0.088 < (Wh - Tf)/Pf < 0.342 \quad \text{[Formula 2]}$$

$$a \cdot Wp^2 + b \cdot Wp + c < Wh \quad \text{[Formula 3]}$$

where $$a = 0.004 \cdot Pf^2 - 0.0696 \cdot Pf + 0.3642$$

$$b = -0.0036 \cdot Pf^2 + 0.0625 \cdot Pf - 0.5752, \text{ and}$$

$$c = 0.0007 \cdot Pf^2 + 0.1041 \cdot Pf + 0.2333.$$

The present invention according to a second aspect thereof is the corrugated fins for heat exchanger according to the first aspect, in which the corrugated fins satisfy the following conditions and a gaseous body flows in the width direction of the fins, $$0.100 < (Wh - Tf)/Pf < 0.320 \quad \text{[Formula 4]}$$

$$a' Wp^2 + b' \cdot Wp + c' < Wh \quad \text{[Formula 5]}$$

where $$a' = 0.004 \cdot Pf^2 - 0.0694 \cdot Pf + 0.3635$$

$$b' = -0.0035 \cdot Pf^2 + 0.0619 \cdot Pf - 0.5564, \text{ and}$$

$$c' = 0.0007 \cdot Pf^2 + 0.1114 \cdot Pf + 0.2304.$$

The present invention according to a third aspect thereof is the corrugated fins for heat exchanger according to the first aspect, in which the corrugated fins satisfy the following conditions and a gaseous body flows in the width direction of the fins, $$0.118 < (Wh - Tf)/Pf < 0.290 \quad \text{[Formula 6]}$$

$$a'' \cdot Wp^2 + b'' \cdot Wp + c'' < Wh \quad \text{[Formula 7]}$$

where $$a'' = 0.0043 \cdot Pf^2 - 0.0751 \cdot Pf + 0.3952$$

$$b'' = -0.0038 \cdot Pf^2 + 0.0613 \cdot Pf - 0.6019, \text{ and}$$

$$c'' = 0.0017 \cdot Pf^2 + 0.1351 \cdot Pf + 0.2289.$$

The corrugated fin of the present invention can be produced by a general purpose manufacturing method for roll machining and so forth and the specification thereof is made to satisfy [Formula 1] to [Formula 3], and thus it is possible to provide the corrugated fin which is improved in heat dissipation and is easy to machine in comparison with the conventional type corrugated fin by forming. In a cell region which is surrounded by flat tubes and a rising wall and a falling wall of the fin as shown in FIG. 2, flows of a gaseous body such as air that passes therein as two swirling flows which progress in a gaseous body flowing direction and thereby efficiently guide a fluid at a central part in the cell to the fin.

BRIEF DESCRIPTION OF THE DRAWINGS

FIGS. 15(*a-a*), 15(*b-b*), 15(*c-c*), 15(*d-d*) show flows (a velocity distribution in the section) of the fluid in each cell in order similarly to FIG. 14, in the conventional type corrugated fins. (FIG. 15 is not prior art because the velocity distribution shown therein is the work of the inventors of the present invention.)

DETAILED DESCRIPTION OF THE INVENTION

Next, embodiments of the present invention will be described on the basis of the drawings.

Figure 5:
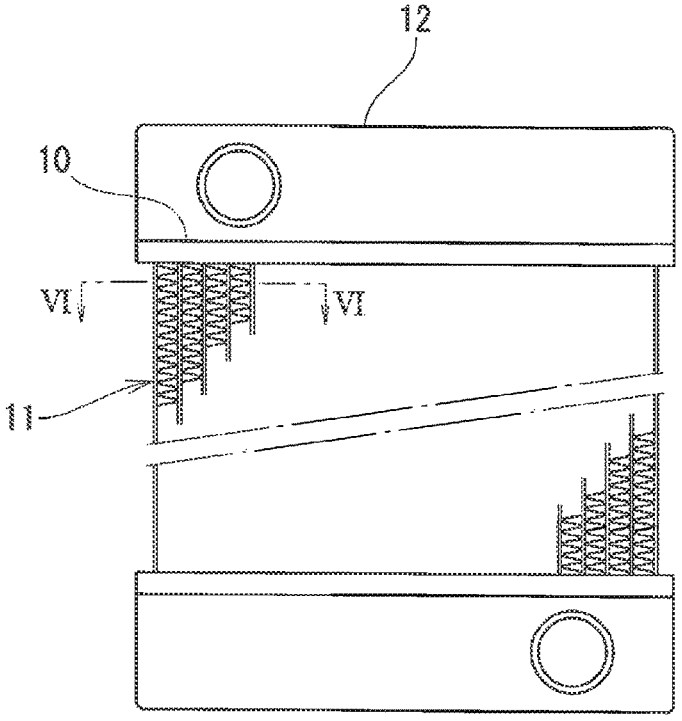
FIG. 5 is a front view of a heat exchanger using the same corrugated fins.
Figure 6:
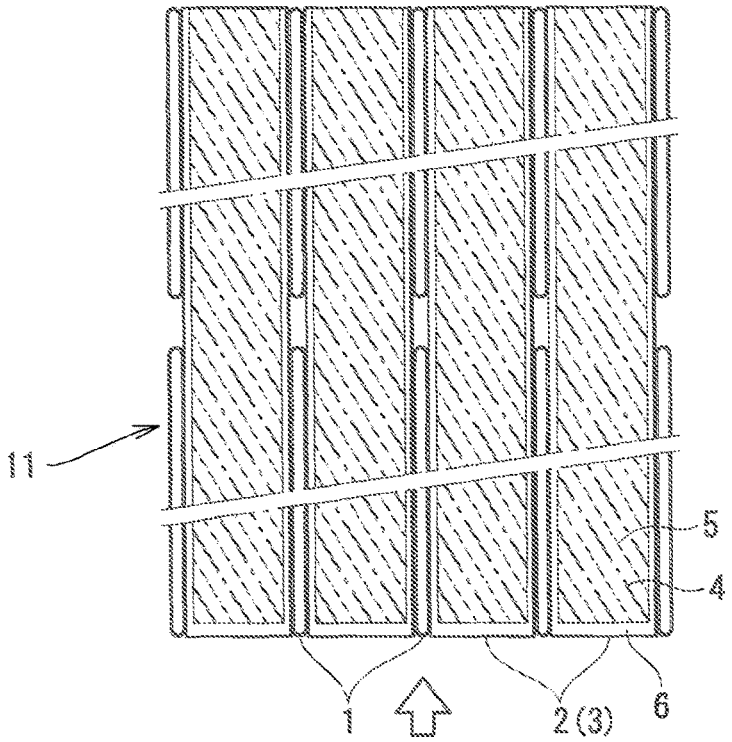
FIG. 6 is a schematic diagram on arrow along VI-VI in FIG. 5.

FIG. 5 is one example of a heat exchanger using corrugated fins of the present invention, and FIG. 6 is a schematic sectional diagram on arrow along VI-VI of FIG. 5.

In this heat exchanger, corrugated fins 2 are arranged between many flat tubes 1 which are arrayed side by side and are integrally brazed and fixed together between contact parts thereof to form a core 11. Then, upper and lower both end parts of each flat tube 1 communicate into tanks 12 via header plates 10.

Figure 1:
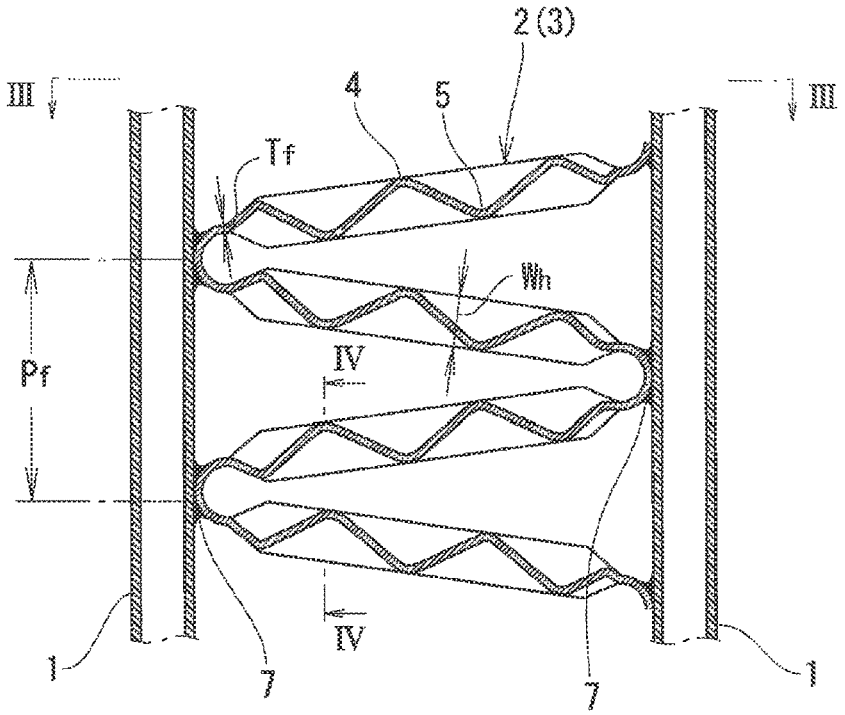
FIG. 1 is an essential part front view of corrugated fins for heat exchanger of the present invention.
Figure 2:
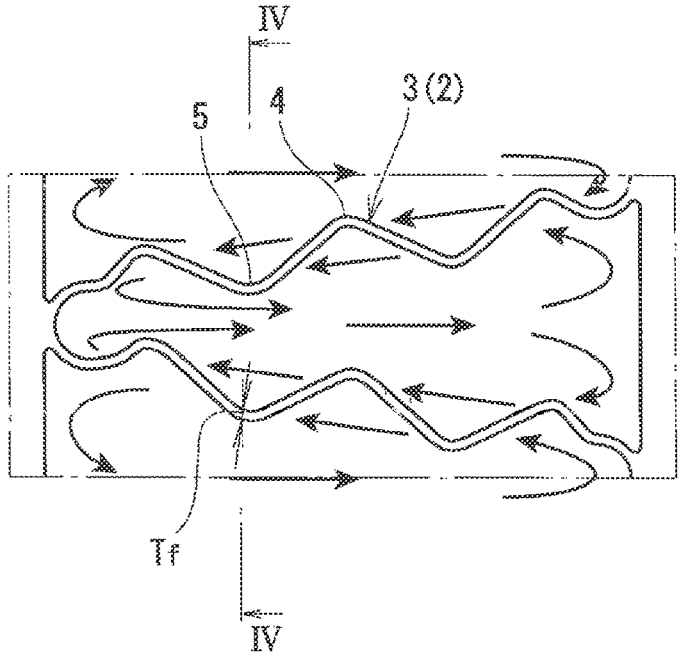
FIG. 2 is an explanatory diagram showing an action of the same fin.
Figure 3:
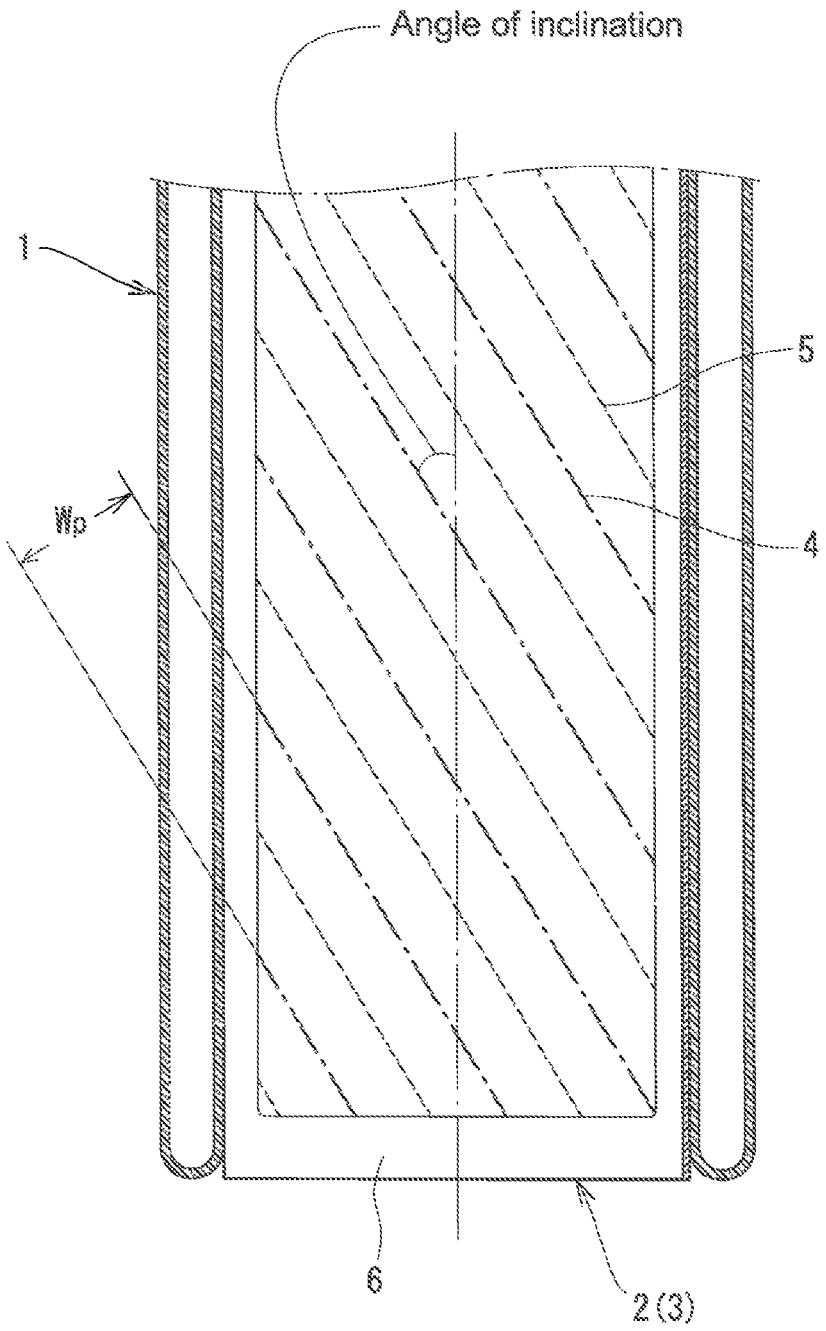
FIG. 3 is a schematic diagram on arrow along in FIG. 1.
Figure 4:
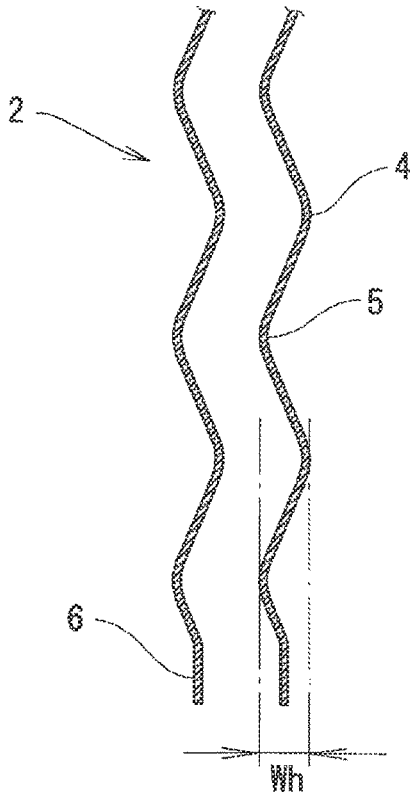
FIG. 4 is a schematic sectional diagram on arrow along IV-IV in FIG. 1 and FIG. 2.

As shown in FIG. 1 to FIG. 4, this corrugated fin 2 is obtained by bending a metal plate made of aluminum (including an aluminum alloy such as, for example, an Al—Mn-based alloy (JIS 3000 series and so forth), an Al—Zn—Mg-based alloy (JIS 7000 series and so forth)) into a waveform, and a peak part 8 and a valley part 9 (FIG. 7) of a bend thereof are brought into contact with the flat tube 1. Then, respective wall surfaces 3 of rising and falling are formed between the peak part 8 and the valley part 9 and ridges 4 and furrows 5 are alternately arranged on the wall surfaces 3. The ridges 4 and the furrows 5 are inclined in parallel with one another and oblique relative to a width direction of the fin as shown in FIG. 3. In the present invention, an angle of inclination thereof is set to 10 degrees to 60 degrees.

Figure 7:
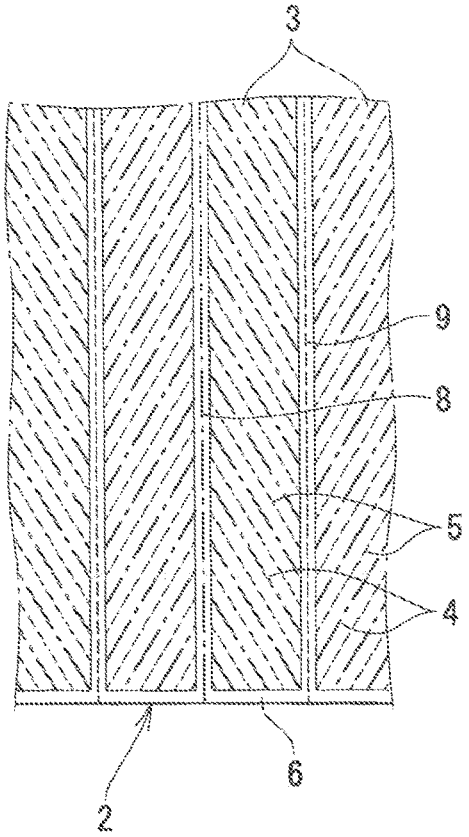
FIG. 7 is a plan view showing a developed state of the same corrugated fins.
Figure 8:
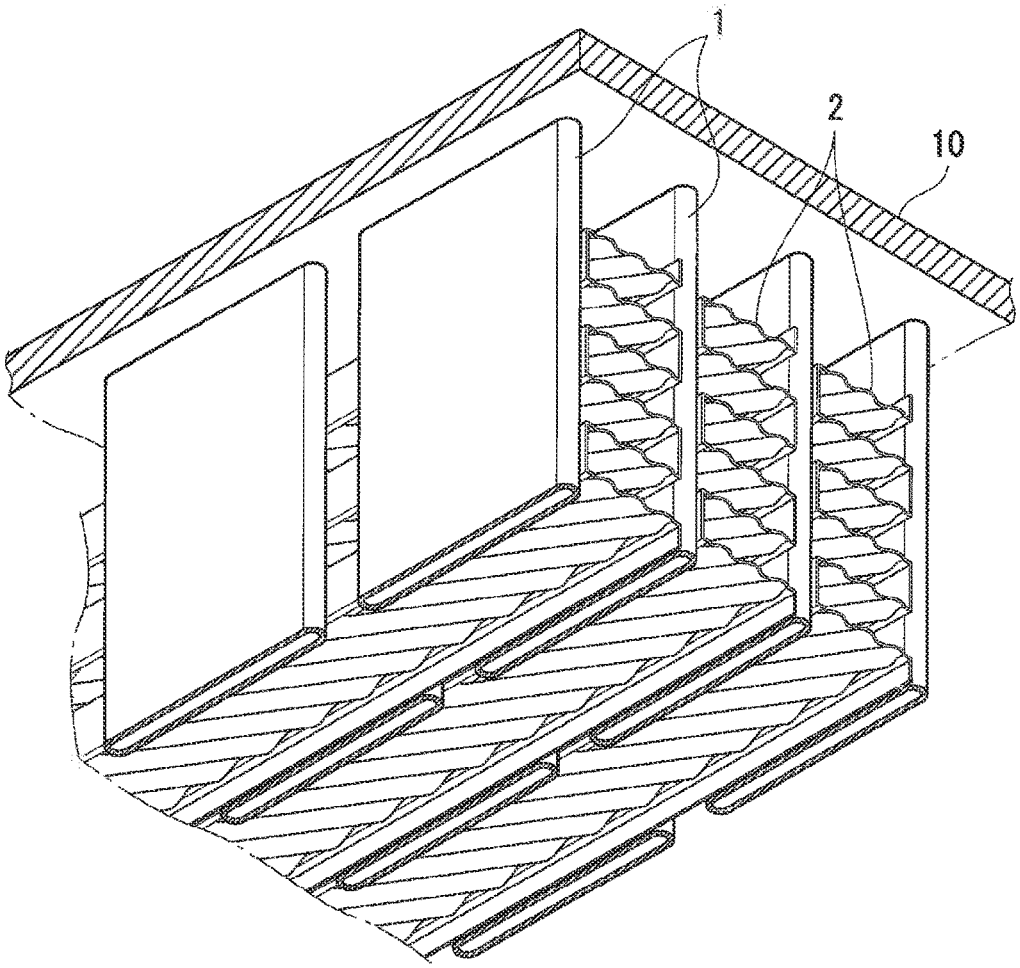
FIG. 8 is an essential part perspective schematic diagram of a heat exchanger using the same corrugated fins.

Although the wall surfaces 3 having such many ridges 4 and furrows 5, the peak parts 8 and the valley parts 9 are integrally formed, when shown intentionally by a development diagram, it can be expressed as in FIG. 7.

That is, in the corrugated fin 2, the peak parts 8 and the valley parts 9 are alternately formed in a longitudinal direction of the fin separately from each other and the wall surface 3 is present between them. The linear ridges 4 and furrows 5 which are symmetrical to the peak part 8 are formed obliquely on the respective wall surfaces 3 facing each other when the fin is formed. FIG. 3 is a partially enlarged diagram thereof and the ridge 4 is indicated by a chain line and the furrow 5 is indicated by a dotted line.

Incidentally, as shown in the same drawing, the ridges 4 and the furrows 5 are not formed on a leading end of the corrugated fin 2 and a flat part 6 is provided thereon.

(Feature of the Corrugated Fin)

A feature of the present invention lies in the point that the height Wh of the ridges and furrows, the period Pf of the corrugated fins and the plate thickness Tf of the fin in FIG. 1, and the period Wp of the ridges and furrows in FIG. 3 have been set to have a specific relation. Determination of respective specifications of them has been obtained from the following experiments and flow analyses of the fluid, and the machining limit of the aluminum fin. In the following, description will be made in order.

Although within a range that the influence of the reduction in flow rate caused by the increase in pressure loss does not become predominant, the larger the height Wh of the ridges and furrows of the fin becomes, the higher the heat transfer performance becomes, the height Wh of the ridges and furrows is limited also by the machining limit of the fin.

Figure 9:
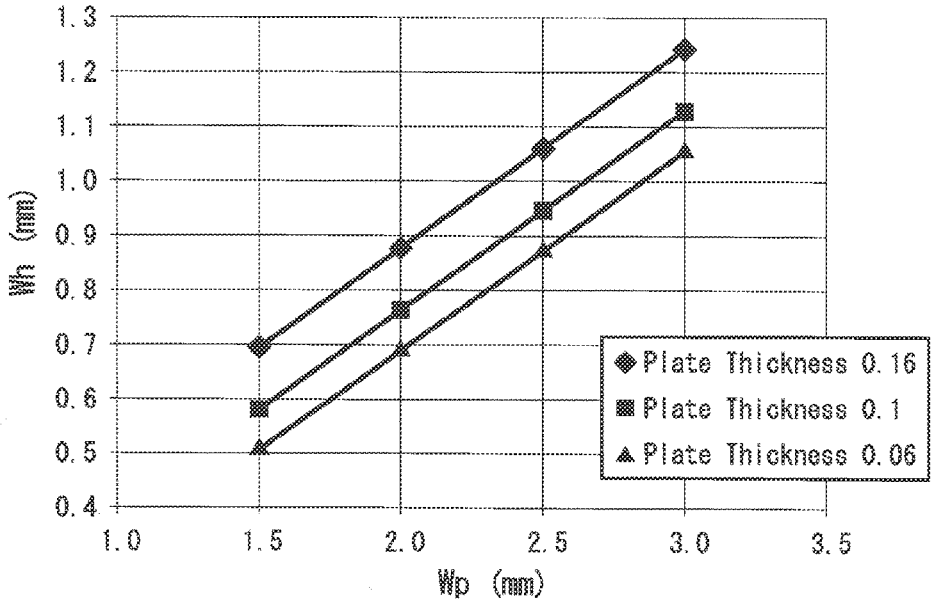
FIG. 9 shows machining limit for every fin plate thickness when the same corrugated fins are produced, in which the period Wp of the ridges and furrows is taken on the horizontal axis and the height Wh of the ridges and furrows is taken on the vertical axis.

FIG. 9 obtains the relation between the period Wp of the ridges and furrows on the wall surface and the height Wh of the ridges and furrows at a limit of bend machining of the fin for every plate thickness. A machining limit of the aluminum fin of 0.06 mm in plate thickness is plotted by (▲), and when the period Wp of the ridges and furrows is 1.5 mm, 0.5 mm is the upper limit of the height Wh of the ridges and furrows.

Likewise, when Wp is 2.0 mm, 0.7 mm is the upper limit of the height Wh. Further, when Wp is 2.5 mm, about 0.87 mm is the upper limit.

Likewise, the machining limit in the case of the plate thickness 0.1 mm and the machining limit in the case of the plate thickness 0.16 mm are plotted by (■) and (♦), respectively.

[Formula 1] expresses the machining limit shown in this FIG. 9 as a numerical formula.

$$Wh \leq 0.3674 \cdot Wp + 1.893 \cdot Tf - 0.1584 \quad \text{[Formula 1]}$$

Figure 10:
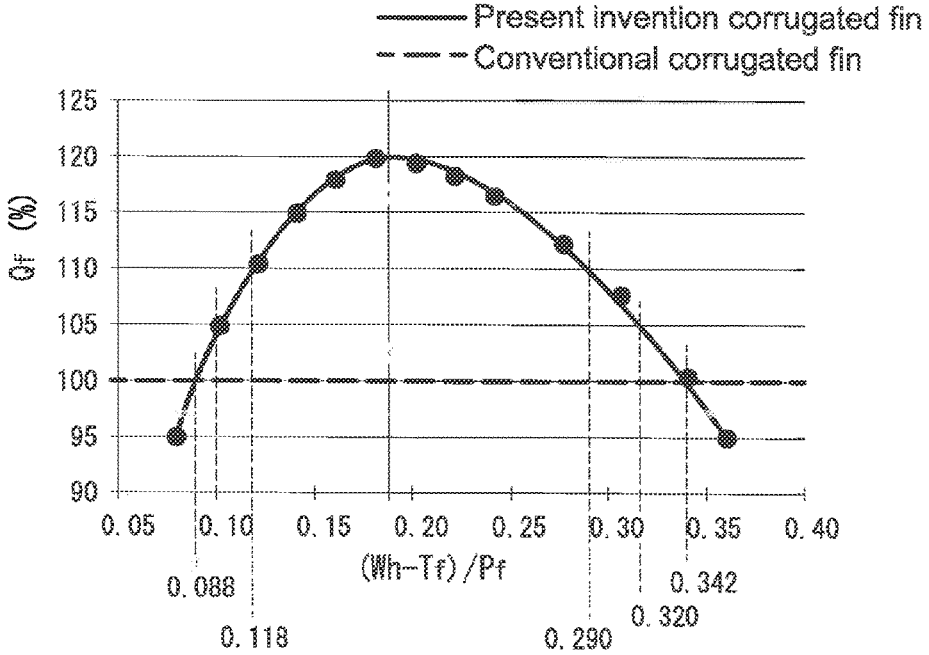
FIG. 10 shows a ratio (in the case of the conventional type corrugated fin, the ratio is set to 100%) of a heat exchange amount (hereinafter, referred to as a fan matching heat radiation amount) in consideration of a reduction in flow rate caused by a pressure loss, in which the ratio is taken on the vertical axis and (Wh−Tf)/Pf is taken on the horizontal axis.

Next, FIG. 10 is a graph obtained by experimentally finding how excellent the fan matching heat radiation amount of the present invention is over that of the conventional type corrugated fin and by plotting a heat radiation amount ratio Qf thereof (in the case of the conventional type corrugated fin, the ratio is set to 100%).

The following matters were clarified therefrom.

The fan matching heat radiation amount ratio of the present invention has a maximum value and the value thereof is about 120% relative to that of the conventional type corrugated fin.

Incidentally, the reason why the maximum value is present is that although a heat transfer enhancement effect owing to generation of the swirling flow is increased up to some extent in association with an increase in (Wh−Tf)/Pf, when it is further increased, the influence of the reduction in flow rate caused by the increase in pressure loss becomes predominant and the heat transfer amount is lowered.

[Formula 2] expresses a range of (Wh−Tf)/Pf within which the fan matching heat radiation amount ratio which is shown in this FIG. 10 becomes larger than 100% by a numerical formula.

$$0.088 < (Wh - Tf)/Pf < 0.342 \quad \text{[Formula 2]}$$

Figure 11:
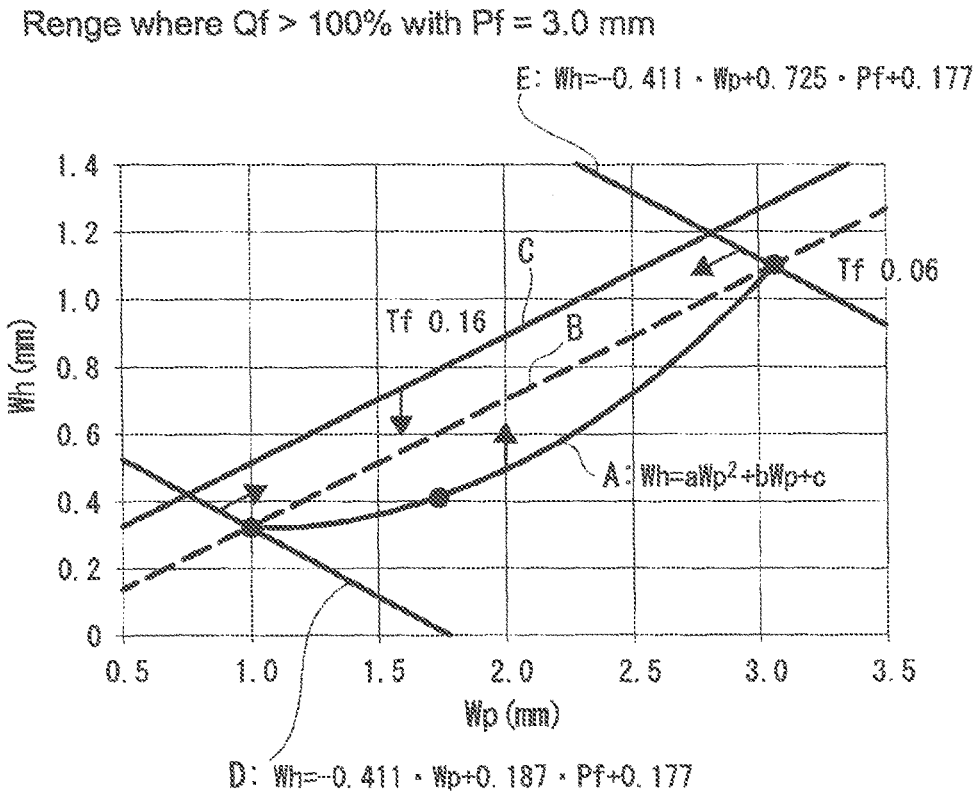
FIG. 11 is a graph indicating a range within which the fan matching heat radiation amount is improved in comparison with the conventional type corrugated fin in a case of the period Pf of the corrugated fins=3 mm, in which the period Wp of the ridges and furrows is taken on the horizontal axis and the height Wh of the ridges and furrows is taken on the vertical axis.

Next, FIG. 11 illustrates, as one example, a range within which in a case where the period Pf of the corrugated fins is 3.0 mm, the fin of the present invention can be machined and the fan matching heat radiation amount ratio thereof becomes larger than 100% in comparison with that of the conventional type corrugated fin.

In FIG. 11, a curved line A is the lower limit (see [Formula 3]) of the height Wh of the ridges and furrows at which the fan matching heat radiation amount ratio becomes larger than 100%.

$$a \cdot Wp^2 + b \cdot Wp + c < Wh \quad \text{[Formula 3]}$$

where $$a = 0.004 \cdot Pf^2 - 0.0696 \cdot Pf + 0.3642$$

$$b = -0.0036 \cdot Pf^2 + 0.0625 \cdot Pf - 0.5752, \text{ and}$$

$$c = 0.0007 \cdot Pf^2 + 0.1041 \cdot Pf + 0.2333.$$

A straight line B is a machining upper limit (see [Formula 1]) in a case where the plate thickness Tf of the fin is 0.06 mm, and a straight line C is the machining upper limit (see [Formula 1]) in a case where the plate thickness Tf of the fin is 0.16 mm.

A straight line D indicates a lower limit of (Wh−Tf)/Pf at which the fan matching heat radiation amount ratio becomes larger than 100% in consideration of the machining upper limit and is obtained by simultaneously setting up the upper limit of Wh (Wh=0.3674·Wp+1.893·Tf−0.1584) in [Formula 1] and the lower limit (0.088=(Wh·Tf)/Pf) of (Wh−Tf)/Pf in [Formula 2] and by deleting Tf.

Likewise, a straight line E indicates an upper limit of (Wh−Tf)/Pf at which the fan matching heat radiation amount ratio becomes larger than 100% in consideration of the machining upper limit and is obtained by simultaneously setting up the upper limit of Wh in [Formula 1] and the upper limit of (0.342=(Wh−Tf)/Pf) of (Wh−Tf)/Pf in [Formula 2] and by deleting Tf.

That is, in the case where the plate thickness Tf of the fin is 0.06 mm, machining of the fin is possible and the fan matching heat radiation amount ratio thereof becomes larger than 100% in comparison with the conventional type corrugated fin within a range surrounded by the curved line A and the straight line B.

In addition, in the case where the plate thickness Tf of the fin is 0.16 mm, machining of the fin is possible and the fan matching heat radiation amount ratio thereof becomes larger than 100% in comparison with the conventional type corrugated fin within a range surrounded by the curved line A, the straight line C, the straight line D and the straight line E.

Figure 12:
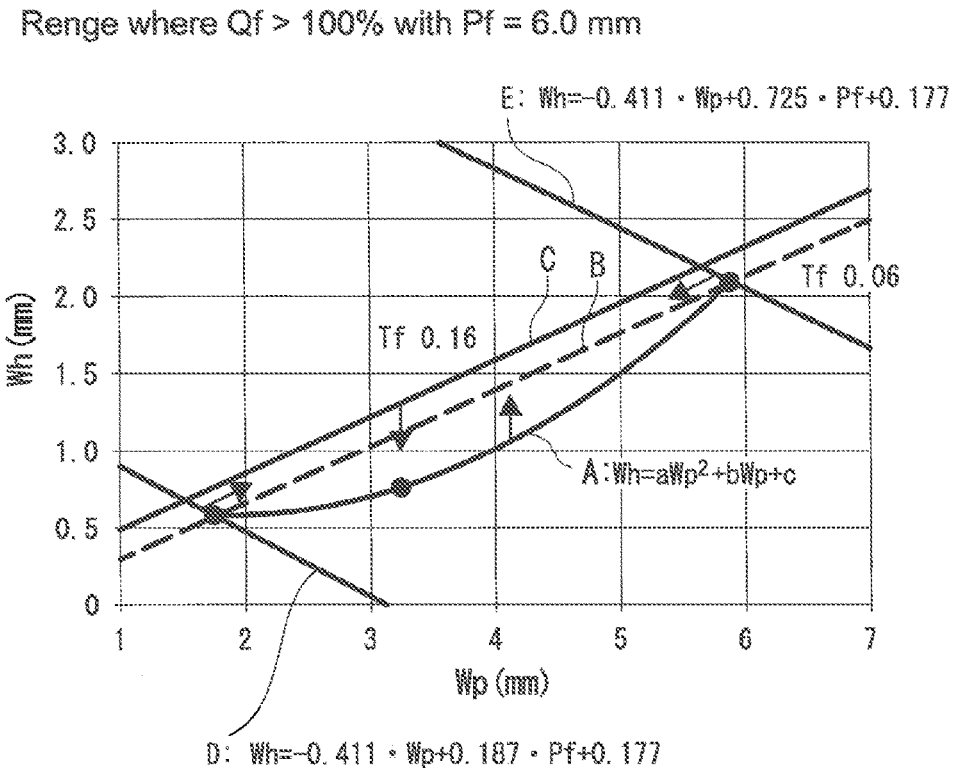
FIG. 12 is a graph in a case where the period Pf of the same corrugated fins is 6 mm.
Figure 13:
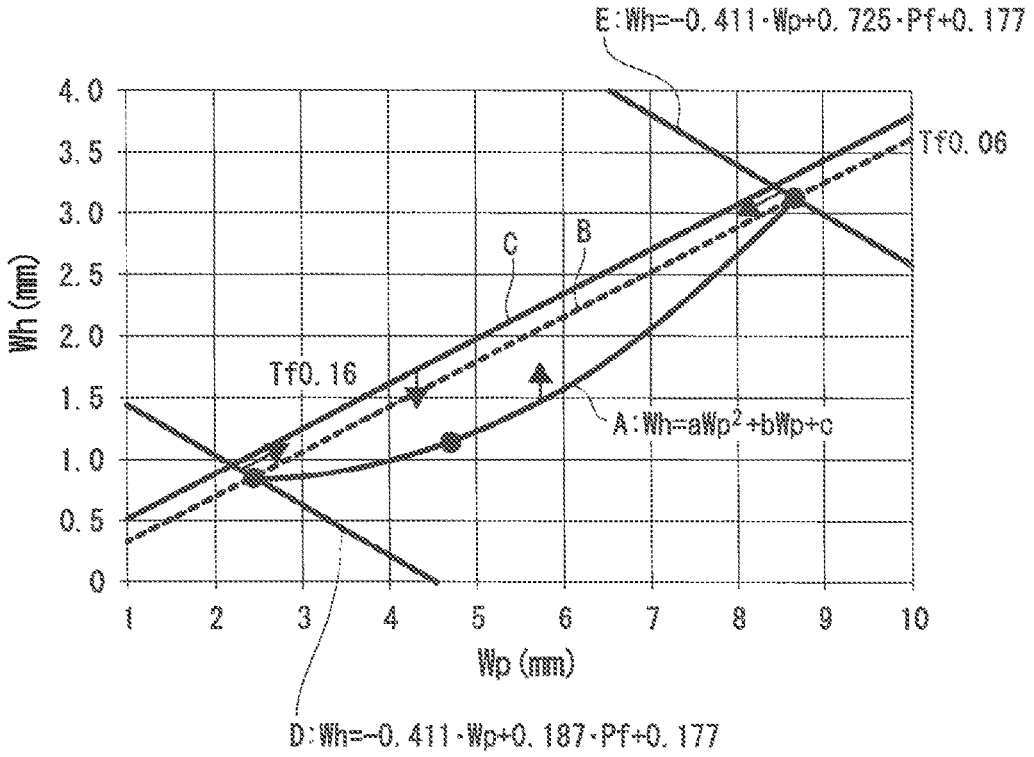
FIG. 13 is a graph in a case where the period Pf of the same corrugated fins is 9 mm.
Figure 14A:
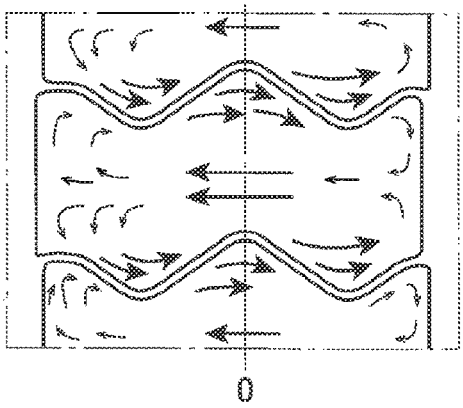
FIGS. 14A, 14B, 14C, 14D show a velocity distribution in each cell (between a wall surface of the fin and one pair of flat tubes) of the fin for heat exchanger using the corrugated fins of the present invention, and shows respective sections in which a fluid moves from a section A to the downstream side in order, to indicate flows of the fluid in the respective cells of the fin in order.
Figure 14B:
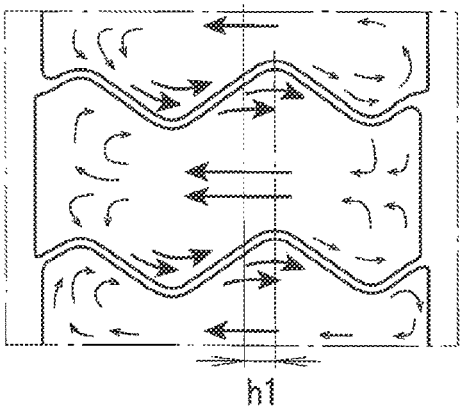
Figure 14C:
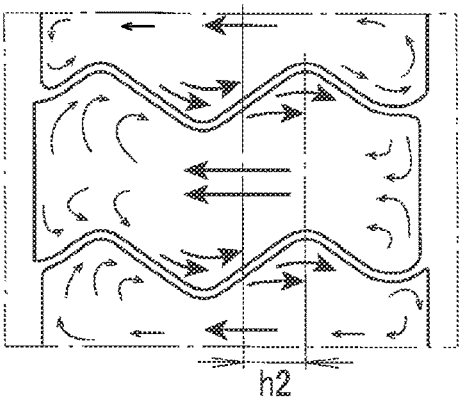
Figure 14D:
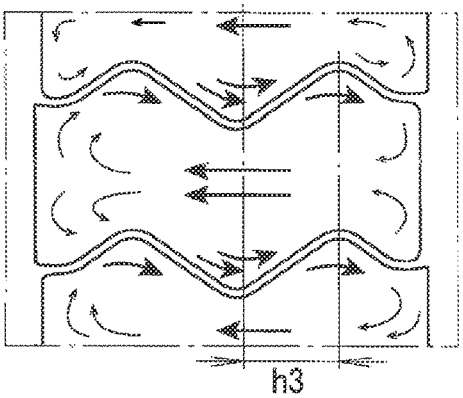
Figure 16:
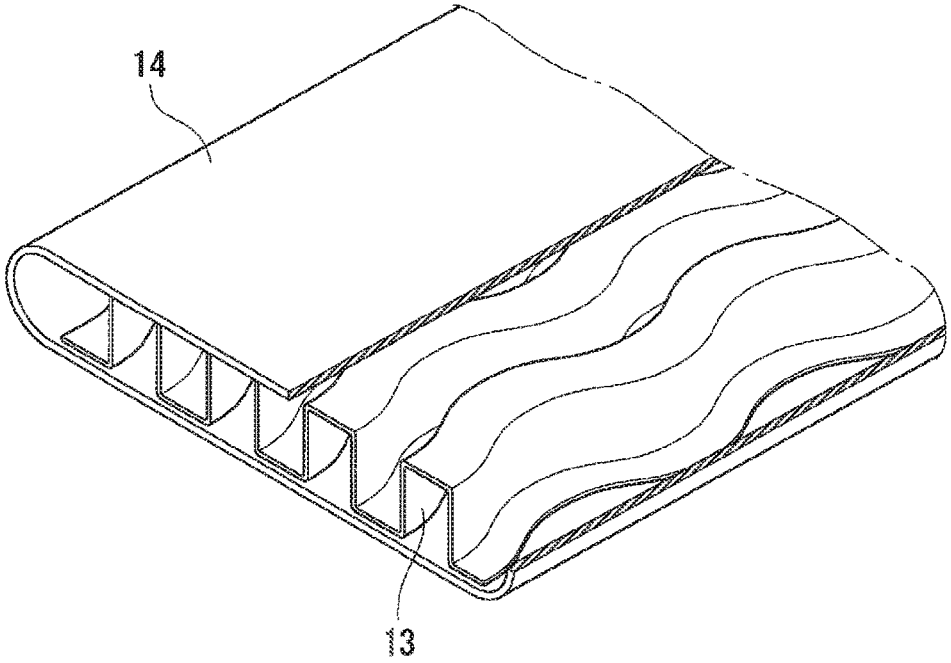
Fig.16 PRIOR ART
FIG. 16 is an essential part perspective view of the conventional type corrugated fins.

Next, FIG. 12 and FIG. 13 illustrate, as other examples, similarly ranges where the fin of the present invention can be machined and the fan matching heat radiation amount ratio thereof becomes larger than 100% in comparison with the conventional type corrugated fin, in cases where the periods Pf of the corrugated fins are 6.0 mm and 9.0 mm, respectively.

In addition, [Formula 4] expresses a range of (Wh−Tf)/Pf within which the fan matching heat radiation amount ratio becomes larger than 105% by a numerical formula, and [Formula 5] expresses the lower limit of the height Wh of the ridges and furrows in that case.

$$0.100 < (Wh - Tf)/Pf < 0.320 \quad \text{[Formula 4]}$$

$$a' \cdot Wp^2 + b' \cdot Wp + c' < Wh \quad \text{[Formula 5]}$$

where $$a' = 0.004 \cdot Pf^2 - 0.0694 \cdot Pf + 0.3635$$

$$b' = -0.0035 \cdot Pf^2 + 0.0619 \cdot Pf - 0.5564, \text{ and}$$

$$c' = 0.0007 \cdot Pf^2 + 0.1114 \cdot Pf + 0.2304.$$

Further, [Formula 6] expresses a range of (Wh−Tf)/Pf within which the fan matching heat radiation amount ratio becomes larger than 110% by a numerical formula, and [Formula 7] expresses the lower limit of the height Wh of the ridges and furrows in that case.

$$0.118 < (Wh - Tf)/Pf < 0.290 \quad \text{[Formula 6]}$$

$$a'' \cdot Wp^2 + b'' \cdot Wp + c'' < Wh \quad \text{[Formula 7]}$$

where $$a'' = 0.0043 \cdot Pf^2 - 0.0751 \cdot Pf + 0.3952$$

$$b'' = -0.0038 \cdot Pf^2 + 0.0613 \cdot Pf - 0.6019, \text{ and}$$

$$c'' = 0.0017 \cdot Pf^2 + 0.1351 \cdot Pf + 0.2289.$$

Next, FIGS. 14A, 14B, 14C, 14D illustrate flows of the fluid in the fin in order from a section A to a section D from the upstream side to the downstream side when the corrugated fin of the present invention is interposed between the flat tubes and the gaseous body is made to flow into a segment which is formed between the wall surface of that fin and the tubes facing each other.

In this example, the ridges and the furrows of the fin move from the center rightward in the drawing to h1, h2 and h3 as they go toward the downstream side. In association therewith, the fluid between the ridge and the furrow is guided rightward in the drawing, is deflected toward the facing fin by a right-side tube surface, flows leftward together with the flow from the facing fin, and is deflected toward the original fin by a left-side tube surface.

The swirling flow is generated in this way and also the fluid at a part remote from the fin sequentially comes close to the fin and transfers heat thereto, and thereby the heat transfer performance is improved relative to the conventional type corrugated fin.

Incidentally, also in the corrugated fin of the present invention which is exemplified in FIG. 2, the same swirling flow is generated.

Figure 17:
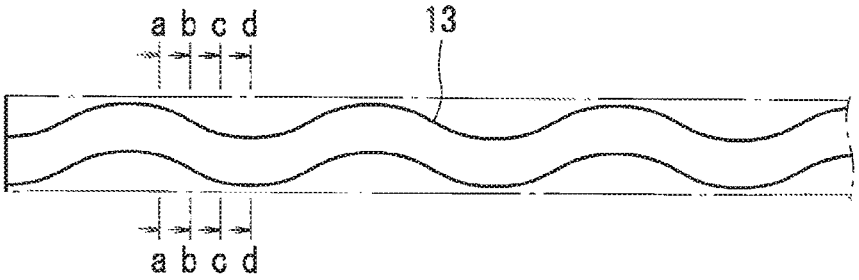
Fig.17 PRIOR ART
FIG. 17 is a top plan view of the same fin.

On the other hand, although FIGS. 15(*a-a*), 15(*b-b*), 15(*c-c*), 15(*d-d*) illustrate the flows on the respective sections of the conventional type corrugated fin in FIG. 17, such a swirling flow as mentioned-above is not generated here.

This corrugated fin can be applied to various heat exchangers such as a radiator, a capacitor, and an EGR cooler and can be also applied to a case of heating or cooling the gaseous body which flows into that corrugated fin. In addition, the entire shape of the corrugated waveform of the corrugated fin may be any of a rectangular wave-shape, a sinusoidal wave-shape, and a trapezoidal wave-shape. In addition, the ridges and the furrows which are formed on the wall surface of the fin other than the peak part and the valley part of the corrugated fin may be any of a sinusoidal wave, a triangular wave, a trapezoidal wave, a curved shape, a combination thereof in cross sections thereof.

The invention claimed is:

1. Corrugated fins for a heat exchanger, wherein the corrugated fins are configured to be interposed between heat exchanger flat tubes which are arrayed side by side or to be installed in the flat tubes, wherein:

the fins are made of a plate of aluminum or an aluminum alloy;

the plate is 0.06 to 0.16 mm in thickness and has respective wall surfaces forming a rising part and a falling part between a peak part and a valley part of a waveform into which the plate has been bent in a longitudinal direction of the fin;

ridges and furrows which are 10 degrees to 60 degrees in angle of inclination relative to a width direction of the fin and are in the same direction are alternately arrayed side by side on the respective wall surfaces; and when a height of the ridges and furrows, which is a dimension from the base of a furrow to the peak of a ridge, including the plate thickness, is set to Wh[mm], a period of the ridges and furrows, which is a distance from one said ridge to a next said ridge, is set to Wp[mm], a period of the waveform of the corrugated fins is set to Pf[mm] and the plate thickness of the fin is set to Tf[mm], and the corrugated fins satisfy the following conditions and a gaseous medium flows in the width direction of the fins, $$Wh \leq 0.3674 \cdot Wp + 1.893 \cdot Tf - 0.1584 \quad \text{[Formula 1]}$$

$$0.088 < (Wh - Tf)/Pf < 0.342 \quad \text{[Formula 2]}$$

$$a \cdot Wp^2 + b \cdot Wp + c < Wh \quad \text{[Formula 3]}$$

where $$a = 0.004 * Pf^2 - 0.0696 \cdot Pf + 0.3642$$

$$b = -0.0036 \cdot Pf^2 + 0.0625 \cdot Pf - 0.5752, \text{ and}$$

$$c = 0.0007 \cdot Pf2 + 0.1041 \cdot Pf + 0.2333.$$

2. The corrugated fins according to claim 1, wherein the corrugated fins also satisfy the following conditions and a gaseous body flows in the width direction of the fins, $$0.100 < (Wh - Tf)/Pf < 0.320 \quad \text{[Formula 4]}$$

$$a' \cdot Wp^2 + b' \cdot Wp + c' < Wh \quad \text{[Formula 5]}$$

where $$a' = 0.004 \cdot Pf^2 - 0.0694 \cdot Pf + 0.3635$$

$$b' = -0.0035 * Pf^2 + 0.0619 \cdot Pf - 0.5564, \text{ and}$$

$$c' = 0.0007 \cdot Pf^2 + 0.1114 \cdot Pf + 0.2304.$$

3. The corrugated fins according to claim 1, wherein the corrugated fins also satisfy the following conditions and a gaseous body flows in the width direction of the fins, $$0.118 < (Wh - Tf)/Pf < 0.290 \quad \text{[Formula 6]}$$

$$a'' \cdot Wp^2 + b'' \cdot Wp + c'' < Wh \quad \text{[Formula 7]}$$

where $$a'' = 0.0043 \cdot Pf^2 - 0.0751 \cdot Pf + 0.3952$$

$$b'' = -0.0038 \cdot Pf^2 + 0.0613 \cdot Pf - 0.6019, \text{ and}$$

$$c'' = 0.0017 \cdot Pf^2 + 0.1351 \cdot Pf + 0.2289.$$

* * * * *